US011557199B2

(12) United States Patent
Geffroy et al.

(10) Patent No.: US 11,557,199 B2
(45) Date of Patent: Jan. 17, 2023

(54) METHOD FOR RESETTING LIFE DIAGNOSIS ALARM OF A CONTACT OF A CONTACTOR

(71) Applicant: Schneider Electric Industries SAS, Rueil-Malmaison (FR)

(72) Inventors: Vincent Geffroy, Shanghai (CN); Bing Shuang, Shanghai (CN); Jean-Luc Bertocchi, Eybens (FR); Juan Xie, Shanghai (CN)

(73) Assignee: Schneider Electric Industries SAS, Rueil-Malmaison (FR)

( * ) Notice: Subject to any disclaimer, the term of this patent is extended or adjusted under 35 U.S.C. 154(b) by 6 days.

(21) Appl. No.: 17/377,736

(22) Filed: Jul. 16, 2021

(65) Prior Publication Data

US 2022/0020265 A1 Jan. 20, 2022

(30) Foreign Application Priority Data

Jul. 16, 2020 (CN) ..... 202010686209.3

(51) Int. Cl.

| | |
|---|---|
| ***G08B 29/12*** | (2006.01) |
| ***G08B 21/18*** | (2006.01) |
| *G08B 3/10* | (2006.01) |
| *G08B 5/38* | (2006.01) |
| *G08B 7/06* | (2006.01) |

(52) U.S. Cl.

CPC ..... *G08B 29/123* (2013.01); *G08B 21/185* (2013.01); *G08B 3/10* (2013.01); *G08B 5/38* (2013.01); *G08B 7/06* (2013.01)

(58) Field of Classification Search

CPC ..... G08B 29/123

See application file for complete search history.

(56) References Cited

U.S. PATENT DOCUMENTS

| | | | | |
|---|---|---|---|---|
| 4,777,474 | A * | 10/1988 | Clayton | G08B 1/08 340/407.1 |
| 5,014,039 | A * | 5/1991 | Zelenka | G08B 15/00 340/565 |
| 5,663,711 | A * | 9/1997 | Sanders | G08B 21/185 340/654 |
| 7,391,319 | B1 * | 6/2008 | Walker | G08B 7/06 340/5.31 |
| 8,599,523 | B1 * | 12/2013 | Ostrovsky | H02H 3/16 361/45 |
| 9,569,949 | B1 * | 2/2017 | Jones | G08B 7/06 |
| 2008/0262708 | A1 * | 10/2008 | Yamaguchi | F02D 41/266 701/112 |
| 2014/0247128 | A1 * | 9/2014 | Young | G08B 13/08 340/541 |

* cited by examiner

*Primary Examiner* — Travis R Hunnings

(74) *Attorney, Agent, or Firm* — Locke Lord LLP

(57) ABSTRACT

The present disclosure relates to a method for resetting life diagnosis alarm of a contact of a contactor, including the following steps:

Step A: detecting a reset signal by a microcontrol unit;

Step B: when the microcontrol unit has detected the reset signal, checking the state of the diagnosis alarm through the microcontrol unit;

and when the diagnosis alarm is in an active state, the microcontrol unit:

Step C: controlling the indicator to give a first indication signal for confirming a reset operation of the diagnosis alarm;

Step D: resetting life diagnosis data;

Step E: controlling the opening and closing of the contact of the contactor through an actuator.

20 Claims, 6 Drawing Sheets

METHOD FOR RESETTING LIFE DIAGNOSIS ALARM OF A CONTACT OF A CONTACTOR

TECHNICAL FIELD

The present disclosure also relates to a contactor comprising at least one said modular breaking units. The invention relates to a method for resetting life diagnosis alarm of a contact of a contactor.

BACKGROUND

Life diagnosis of a contact of a contactor can predict the life of the contact, so as to give an alarm to users when the contact reach the end of life cycle, so that users can carry out maintenance and replacement of the contactor and field equipment in a planned manner, so as to maximize functionality of the contactor, reduce the number of downtime of user equipment, avoid accidents caused by exhausted life of the contactor, save costs for users to the maximum extent, and protect users' assets and personal safety. After the user maintains the contactor and replaces the contact, it is necessary to reset or initialize the historical data of life diagnosis, so as to allow the contactor to restart life diagnosis according to the newly replaced contact, thus ensuring the validity and correctness of life diagnosis.

According to the reset operations of various life diagnosis alarms in contact life diagnosis of the contactors, the invention provides a corresponding method and process for resetting the life diagnosis alarm.

SUMMARY

Therefore, the present invention provides a method for resetting life diagnosis alarm of a contact of a contactor. According to a first embodiment, the method comprises the following steps:

step A: detecting a reset signal by a microcontrol unit;

step B: when the microcontrol unit has detected the reset signal, checking the state of the diagnosis alarm through the microcontrol unit;

and when the diagnosis alarm is in an active state, the microcontrol unit:

step C: controlling the indicator to give a first indication signal for confirming a reset operation of the diagnosis alarm;

step D: resetting life diagnosis data;

step E: controlling the opening and closing of the contact of the contactor through an actuator.

That is, according to the method of the present invention, the reset of the historical data of life diagnosis needs to meet two conditions: first, the microcontrol unit has detected the reset signal; second, the diagnosis alarm of the microcontrol unit is in the active state. In case that both conditions are met, the microcontrol unit also controls the indicator to give the first indication signal to explicitly indicate to an user that after the reset operation has been confirmed, the microcontrol unit resets life diagnosis data by clearing the historical data of life diagnosis and/or initializing life diagnosis data, and then controls the opening and closing of the contact of the contactor through the actuator as required, so that a new contact life diagnosis cycle can be started in the initialized state after the contact of the contactor re-operates, thus ensuring the validity and accuracy of the contact life diagnosis.

According to a first variant of this first embodiment, the method comprises before the step A:

step G: when the contactor is powered off, the reset signal can be provided by changing the position of a first reset switch integrated in the contactor;

step H: under the condition that the contact of the contactor is disconnected, the contactor is powered on again;

and wherein the step A is performed when the step H occurs.

That is, in the first variant, the contactor includes an integrated first reset switch, and a reset signal is provided by changing the position of the first reset switch, so that the whole product is compact and easy to reset. In this case, because the first reset switch is directly integrated in the contactor, in order to ensure safe operation, the contactor should be powered off before operating the first reset switch; the detection of the reset signal requires re-electrifying of the contactor, and the detection of the reset signal occurs when re-electrifying. Thus, in order to ensure the safety of operators and related equipments, the contact of the contactor will be kept open before the resetting is finished.

According to a second variant of this first embodiment, the method comprises before the step A:

step J: a reset signal can be provided by changing position of a second reset switch on a remote diagnosis indication and operation module connected with the contactor;

step K: if the step J occurs when the contactor is powered off, re-electrifying the contactor under the condition that it is confirmed that the contact of the contactor is disconnected; if the step J occurs while the contactor is powered on, the contactor is powered off first, and then re-electrifying the contactor while the contact of the contactor is confirmed to be disconnected;

and wherein the step A is performed when the contactor is re-electrified in the step K.

That is, in the second variant, the contactor includes a remote diagnosis indication and operation module electrically connected with it, and a second reset switch is provided on the remote diagnosis indication and operation module, and the reset signal is provided by changing the position of the second reset switch. By providing the remote diagnosis indication and operation module, the reset signal can be provided more conveniently and safely to start the reset operation. In this case, because the second reset switch is arranged on the remote diagnosis indication and operation module instead of directly on the contactor, the second reset switch can be operated under the condition that the contactor is electrified without involving safety problems. However, no matter whether the contactor is powered-on or powered-off when the second reset switch is operated, the contactor should undergo re-electrification while the contact of the contactor is disconnected, and the reset signal should be detected when the re-electrification occurs. This ensures that the reset operation is safe.

In a more specific implementation according to the first and second variants of the first embodiment, the step E is to close the contact of contactor by the actuator.

That is to say, when resetting the contact life diagnosis data, the user has known the occurrence of life diagnosis alarm, and therefore may have carried out related contact replacement or maintenance operation, so the contact of the contactor can be closed after reset to render the contactor continues to work.

In a more specific implementation according to the first and second variants of the first embodiment, in the step A, if the microcontrol unit does not detect the reset signal, the method proceeds to the step E.

In a more specific implementation according to the first and second variants of the first embodiment, in step B, if the microcontrol unit detects that the diagnosis alarm is in an inactive state, the method proceeds to step E; or the method simultaneously carries out the step E and the following step I: the microcontrol unit controls the indicator to give a second indication signal indicative misoperation of the first reset switch or the second reset switch;

and wherein the second indication signal is different from the first indication signal.

If the reset signal is detected in step A, while the microcontrol unit checks that the diagnosis alarm is in an inactive state, it means that the life diagnosis alarm has not occurred. In this case, the sending of the reset signal is the result of wrong operation of the first reset switch or the second reset switch, so the user can be indicated by the indicator that a misoperation has occurred, and such misoperation should not affect the normal operation of the contactor.

In a more specific implementation according to the first variant and the second variant of the first embodiment, both the first indication signal and the second indication signal are selected from flashing patterns or modes of indicator lights, sounds, or any combination thereof.

According to a third variant of the first embodiment, the method includes a step L before the step A: the reset signal can be received from a remote system through a communication interface of a remote communication module of the contactor while the contactor is powered on.

That is, in this third variant, the contactor includes a remote communication module capable of communicating with a remote system, and the reset signal is sent from the remote system to the remote communication module via a communication interface. With this arrangement, the reset signal can be provided more conveniently and safely, and the reset operation can be started without disconnecting the contact of the contactor in advance or powering off the contactor.

In a more specific implementation of the third variant, if the contact of the contactor is in a closed state when the step L is performed, the method further comprises a step M between the step L and the step A or between the step A or the step B: the microcontrol unit controls the actuator to open the contact of the contactor.

This ensures the safety and effectiveness of the reset operation.

In a more specific implementation of the third variant, the step E is to keep the contact of the contactor open through the actuator.

In a more specific implementation or the third variant, if the microcontrol unit checks that the diagnosis alarm is in an inactive state, the method proceeds to step E after step B.

This situation may indicate the failure or misoperation of the remote communication module or remote system.

In a more specific implementation of the third variant, the method further comprises the following steps after the step E:

step X: the remote communication module receives a closing signal for closing the contact of the contactor from the remote system through the communication interface;

step Y: the remote communication module transmits the closing signal to the microcontrol unit;

and step Z: the microcontrol unit controls the actuator to close the contact of the contactor.

According to the second embodiment of the present invention, a method for resetting life diagnosis alarm of a contact of a contactor is provided, which comprises the following steps:

step J: under the condition that the contact of the contactor is disconnected, providing the reset signal by changing poisition of a second reset switch on a remote diagnosis indication and operation module connected with the contactor;

step A: detecting a reset signal by a microcontrol unit;

step O: under the condition that the microcontrol unit detects the reset signal, the microcontrol unit checks whether the step A occurs when the contactor undergoes re-electrification;

step B: in the step O, if it is checked that the step A occurs when the contactor undergoes re-electrification, the microcontrol unit checks the state of the diagnosis alarm;

and when the diagnosis alarm is in an active state, the microcontrol unit:

step C: controlling the indicator to give a first indication signal for confirming a reset operation of the diagnosis alarm;

step D: resetting the historical data of life diagnosis;

step E: controlling the opening and closing of the contact of the contactor through an actuator.

In a more specific implementation of the second embodiment, if it is checked in the step O that it is not when the contactor undergoes re-electrification that the step A occurs, step G is performed: the microcontrol unit controls the indicator to give a third indication signal indicative error in the reset operation, and the third indication signal is different from the first indication signal.

It can be seen that the most critical difference between this second embodiment and the first embodiment is that before checking the state of the diagnosis alarm through the microcontrol unit, it is necessary to check whether the detection of the reset signal occurs when the contactor is being re-electrified, since in this second embodiment, the second reset switch is arranged on the remote diagnosis indication and operation module, and as a result the second reset switch can be operated either while the contactor is powered on or while the contactor is powered off. The detection of reset signal should occur when the contactor is being re-electrified, so that the subsequent reset operation can be carried out correctly and safely, otherwise, the indicator should report an error.

In a more specific implementation of the second embodiment, the step E is to close the contact of contactor by the actuator.

In a more specific implementation of the second embodiment, in the step A, if the microcontrol unit does not detect the reset signal, the method proceeds to the step E.

In a more specific implementation of the second embodiment, in step B, if the microcontrol unit detects that the diagnosis alarm is in an inactive state, the method proceeds to step E; or the method simultaneously carries out the step E and the following step I: the microcontrol unit controls the indicator to give a second indication signal indicative misoperation of the second reset switch;

and wherein the first indication signal, the second indication signal and the third indication signal are different from each other.

In a more specific implementation of this second embodiment, the first indication signal, the second indication signal and the third indication signal are all selected from flashing patterns or modes of indicator lights, sounds, or any combination thereof.

In all implementations of the present invention, a step N may be further included between the step D and the step E: the microcontrol unit controls the indicator to stop giving the first indication signal.

That is, the stop of the first indication signal can conveniently and clearly indicate the completion of the reset operation, further ensuring the safety and effectiveness of subsequent operations.

BRIEF DESCRIPTION OF THE DRAWINGS

In order to explain the technical solutions of the embodiments of the present disclosure more clearly, the following will briefly introduce the drawings that need to be used in the embodiments. It should be understood that the following drawings only show certain embodiments of the present disclosure, and therefore should not be regarded as a limitation of the scope of protection. For those of ordinary skill in the art, other relevant drawings can be obtained based on these drawings without creative work. In the drawings.

DETAILED DESCRIPTION

Hereinafter, a method for resetting life diagnosis alarm of a contact of a contactor according to an embodiment of the present disclosure will be described in detail with reference to the accompanying drawings. In order to make the objectives, technical solutions, and advantages of the present disclosure clearer, the technical solutions of the embodiments of the present disclosure will be described clearly and completely in conjunction with the accompanying drawings of the embodiments of the present disclosure. Obviously, the described embodiments are part of the embodiments of this disclosure, but not all of them.

Therefore, the following detailed description of the embodiments of the disclosure provided in conjunction with the accompanying drawings is not intended to limit the scope of the claimed disclosure, but only represents selected embodiments of the disclosure. Based on the described embodiments of the present disclosure, all other embodiments obtained by those of ordinary skill in the art without inventive work are within the protection scope of the present disclosure.

Unless the context requires otherwise, the singular includes the plural. Throughout this specification, the terms "including", "comprising", "having", etc. are used herein to specify the presence of stated features, numbers, steps, operations, elements, components or combinations thereof, but do not exclude the presence or addition of one or more other features, numbers, steps, operations, elements, components or combinations thereof.

In addition, even though terms including ordinal numbers such as "first" and "second" can be used to describe various components, these components are not limited by these terms, and these terms are only used to distinguish one element from other elements. For example, a first component may be referred to as a second component, and similarly, a second component may be referred to as a first component without departing from the scope of the present disclosure.

Figure 1:
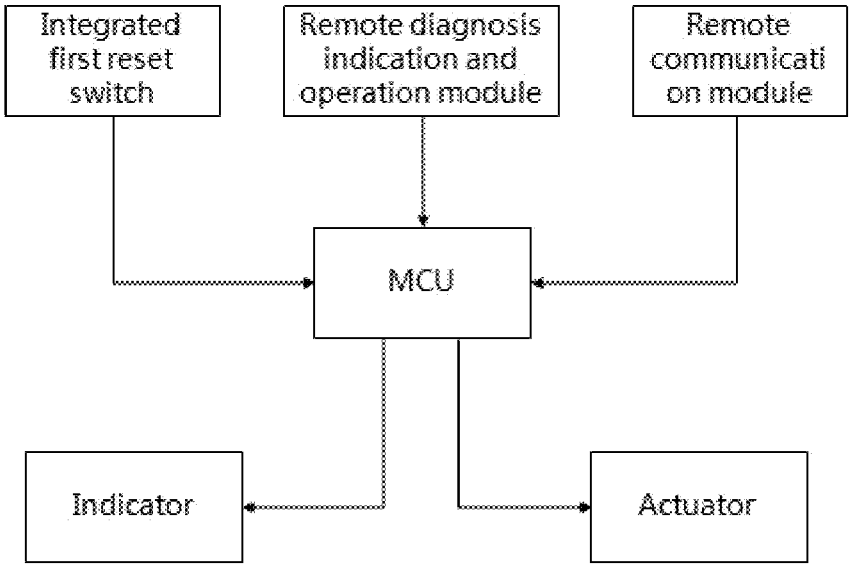
FIG. 1 shows the relevant modules or means included in the contactor used in the method according to the invention.

The invention relates to a method for resetting life diagnosis alarm of a contact of a contactor, wherein, as shown in FIG. 1, the contactor can comprise the following modules or means:

a microcontrol Unit (MCU) which, with internally integrated hardware and software, can store life diagnosis data and optionally perform contact life diagnosis, and can provide diagnosis alarm, detect and receive reset signals and reset diagnosis alarm data. In addition, the microcontrol unit can also control the operation of other modules or means;

an indicator which is used for giving corresponding indication signals under the control of the microcontrol unit, and the indication signals can take different forms when the indication contents are different;

an actuator which is used for controlling the opening and closing of the contact of the contactor under the control of the microcontrol unit. Specifically, the actuator can generate electromagnetic force under the control of the microcontrol unit to control the movement of relevant mechanism components of the contactor and realize the opening and closing control of the contact of the contactor;

a first reset switch integrated in the contactor which is associated with the microcontrol unit and through changing the position of which, a first reset switch can be provided.

In addition, the contactor may also optionally include one or more of the following:

a remote diagnosis indication and operation module electrically connected with the contactor and associated with the microcontrol unit, and a second reset switch is arranged on the remote diagnosis indication and operation module, and an indication signal can be provided through changing the position of the second reset switch; and optionally, the remote diagnosis indication and operation module can also include a normally open contact, and can remotely indicate the diagnosis alarm by closing the normally open contact; and a remote communication module which is associated with the microcontrol unit and which can communicate with a remote system via a communication interface to receive a reset signal from the remote system; optionally, the remote communication module can also provide diagnosis alarm to the remote system via the communication interface.

Hereinafter, various embodiments of the method according to the present invention will be explained with reference to the accompanying drawings.

The First Embodiment

Figure 2:
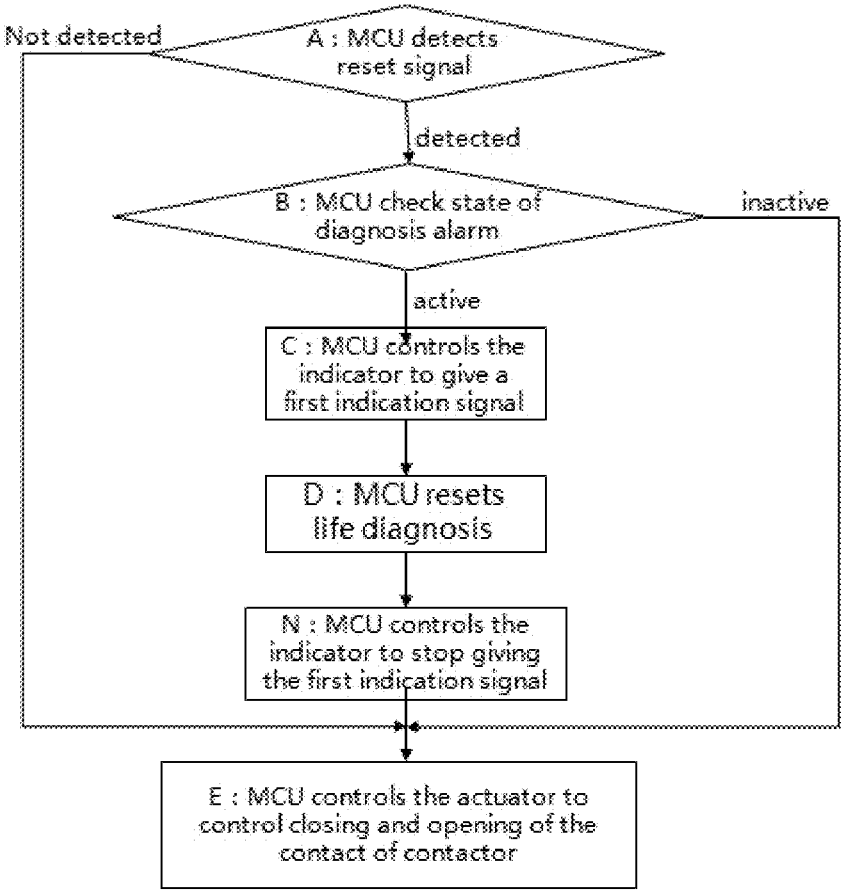
FIG. 2 shows a flowchart of a method according to a first embodiment of the present invention.

As shown in FIG. 2, in the first embodiment of the method for resetting the life diagnosis alarm of the contact of the contactor according to the present invention, the method includes the following steps:

step A: detecting a reset signal by a microcontrol unit;

step B: when the microcontrol unit has detected the reset signal, checking the state of the diagnosis alarm through the microcontrol unit;

and when the diagnosis alarm is in an active state, the microcontrol unit:

step C: controlling the indicator to give a first indication signal for confirming a reset operation of the diagnosis alarm;

step D: resetting life diagnosis data;

step E: controlling the opening and closing of the contact of the contactor through an actuator.

That is, according to the method of the firt embodiment of the present invention, the reset of the historical data of life diagnosis needs to meet two conditions: first, the microcontrol unit has detected the reset signal; second, the diagnosis alarm of the microcontrol unit is in the active state. In this way, the validity and correctness of the reset operation can be ensured, thus avoiding the error reset of the life diagnosis data, which will interfere with the life diagnosis of the contact. In case that both conditions are met, the microcontrol unit also controls the indicator to give the first indication signal which is flashing pattern or mode of indicating lights of indicatins sounds or any combination thereof, to explicitly indicate to an user that after the reset operation of the diagnosis alarm has been confirmed, the microcontrol unit resets life diagnosis data by clearing the historical data of life diagnosis and/or initializing life diagnosis data, and then controls the opening and closing of the contact of the contactor through the actuator as required, so that a new contact life diagnosis cycle can be started in the initialized state after the contact of the contactor is put into use again, thus ensuring the validity and accuracy of the contact life diagnosis.

In a specific implementation according to the first embodiment, the method may further include a step N between step D and step E: the microcontrol unit causes the indicator to stop giving the first indication signal. That is, the stop of the first indication signal can conveniently and clearly indicate the completion of the reset operation, further ensuring the safety and effectiveness of subsequent operations.

Of course, it is also possible to set the first indication signal to be provided within a certain period of time, and automatically stop after this period of time.

In this first embodiment, the reset signal can be generated from a first reset switch integrated in the contactor, a remote diagnosis indication and operation module electrically connected with the contactor or a remote communication module of the contactor communicatively connected with a remote system, and the first, second and third variants of this first embodiment are realized according to the way of generating the reset signal, as will be described in detail below.

The First Variant of the First Embodiment

Figure 3:
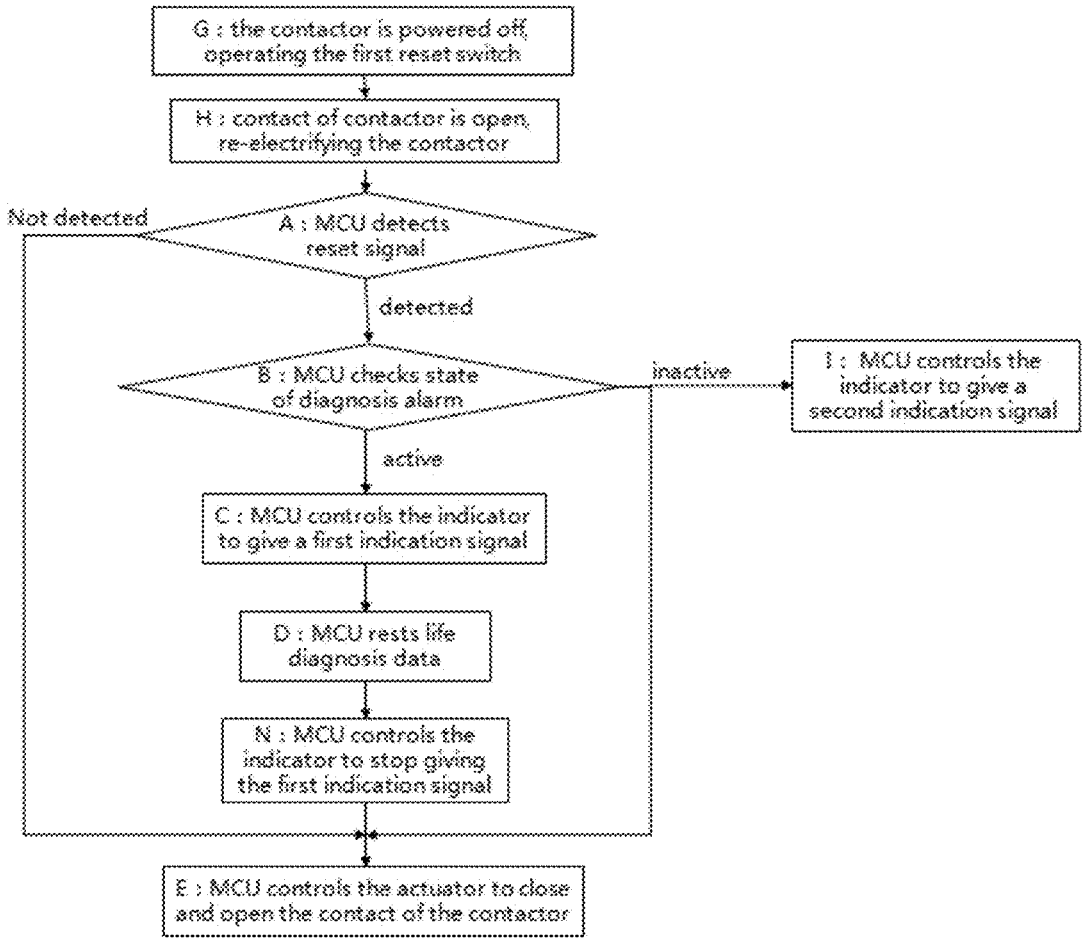
FIG. 3 shows a flowchart of a method according to a first variant of the first embodiment of the present invention.

As shown in FIG. 3, in a first variant according to the first embodiment of the present invention, the reset signal is provided through changing the position of the first reset switch integrated in the contactor, and the method at least includes the following steps:

step G: when the contactor is powered off, the reset signal can be provided by changing the position of a first reset switch integrated in the contactor;

step H: under the condition that the contact of the contactor is disconnected, the contactor is re-electrified;

step A: detecting a reset signal by a microcontrol unit when re-electrifying the contactor;

step B: if the microcontrol unit detected the reset signal in the step A, checking the state of the diagnosis alarm through the microcontrol unit;

and when the diagnosis alarm is in an active state, the microcontrol unit:

step C: controlling the indicator to give a first indication signal for confirming a reset operation of the diagnosis alarm;

step D: resetting life diagnosis data;

step E: closing the contact of the contactor through the actuator; then the method ends.

That is, in the first variant, the contactor includes an integrated first reset switch, and a reset signal is provided by changing the position of the first reset switch, so that the whole product is compact and easy to reset. In this case, because the first reset switch is directly integrated in the contactor, in order to ensure safe operation, the contactor should be powered off before operating the first reset switch; the detection of the reset signal requires re-electrifying of the contactor, and the detection of the reset signal occurs through the microcontrol unit when the contact is re-electrified. Thus, in order to ensure the safety of operators and related equipments, the contact of the contactor will be kept open before the resetting is finished. That is to say, when resetting the contact life diagnosis data, the user has known the occurrence of life diagnosis alarm, and therefore may have carried out related contact replacement or maintenance operation, so the contact of the contactor can be closed after reset to render the contactor continues to work.

In a more specific implementation of this first variant, if the microcontrol unit does not detect the reset signal in step A, as shown in FIG. 3, the method directly proceeds to step E, that is, the microcontrol unit closes the contact of the contactor through the actuator, and then the method ends.

In addition, as shown in FIG. 3, if the microcontrol unit checks that the diagnosis alarm is in an inactive state in step B, the method can also directly proceed to step E, that is, the microcontrol unit closes the contactor through the actuator, and then the method ends; or the method can also carry out step L while carrying out step E: the microcontrol unit controls the indicator to give a second indication signal indicative the misoperation of the first reset switch, and then the method ends. It should be noted that the second indication signal can also adopt a flashing patterns, modes of indicating lights or indicating sounds or their combination, but the second indication signal should be different from the first indication signal, so that the user can easily distinguish and correctly recognize the contents indicated by the indicator each time.

That is in this case, if the reset signal is detected in step A, while the microcontrol unit checks that the diagnosis alarm is in an inactive state, it means that the life diagnosis alarm has not occurred. In this case, the sending of the reset signal is the result of wrong operation of the first reset switch or the second reset switch, so the user can be indicated by the indicator that a misoperation has occurred, and such misoperation should not affect the normal operation of the contactor.

In this way, the method according to various implementations of this first variant may include at least a part of the following flow:

step G: when the contactor is powered off, the reset signal can be provided by changing the position of a first reset switch integrated in the contactor;

step H: under the condition that the contact of the contactor is disconnected, the contactor is re-electrified;

step A: detecting a reset signal by a microcontrol unit; wherein:

if the microcontrol unit does not detect the reset signal in step A, the method proceeds to step E: the microcontrol unit controls the actuator to close the contact of the contactor; then the method ends;

if the microcontrol unit detects the reset signal in step A, the method proceeds to step B: check the state of the diagnosis alarm through the microcontrol unit; wherein:

if the diagnosis alarm is in an inactive state, the method proceeds to step E; or the method simultaneously carries out the above-described step E and the following step I: the microcontrol unit controls the indicator to give a second indication signal indicative misoperation of the second reset switch; and then the method ends;

if the diagnosis alarm is in an active state, the method carries out the following:

step C: the microcontrol unit controls the indicator to give a first indication signal for confirming a reset operation of the diagnosis alarm;

step D: the microcontrol unit resets life diagnosis data;

step N: the microcontrol unit controls the indicator to stop giving the first indication signal;

step E: the method ends.

The Second Variant of the First Embodiment

Figure 4:
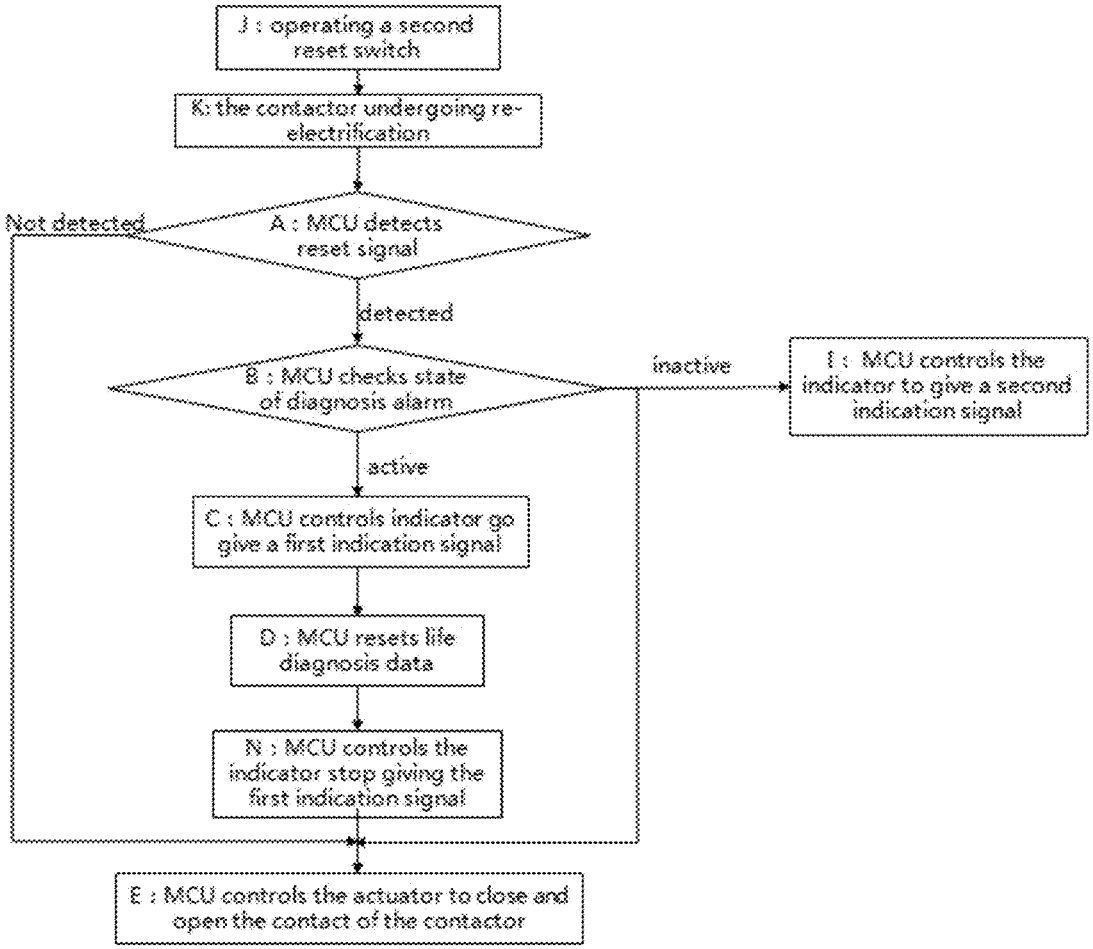
FIG. 4 shows a flowchart of a method according to a second variant of the first embodiment of the present invention.

As shown in FIG. 4, in a second variant according to the first embodiment of the present invention, the essential difference from the first variant is that a reset signal is provided by changing position of a second reset switch on a remote diagnosis indication and operation module electrically connected with the contactor, and the method at least includes the following steps:

step J: a reset signal can be provided by changing position of the second reset switch on the remote diagnosis indication and operation module connected with the contactor;

step K: if the step J occurs while the contactor is powered off, re-electrifying the contactor under the condition that the contact of the contactor is disconnected; if the step J occurs while the contactor is powered on, the contactor is powered off first, and then re-electrifying the contactor while the contact of the contactor is disconnected;

step A: detecting a reset signal by a microcontrol unit when re-electrifying the contactor;

step B: if the microcontrol unit detected the reset signal in the step A, checking the state of the diagnosis alarm through the microcontrol unit;

and when the diagnosis alarm is in an active state, the microcontrol unit:

step C: controlling the indicator to give a first indication signal for confirming a reset operation of the diagnosis alarm;

step D: resetting life diagnosis data;

step E: closing the contact of the contactor through the actuator; then the method ends.

That is, in the second variant, the contactor includes a remote diagnosis indication and operation module electrically connected with it, and a second reset switch is provided on the remote diagnosis indication and operation module, and the reset signal is provided by changing the position of the second reset switch. By providing the remote diagnosis indication and operation module, the reset signal can be provided more conveniently and safely to start the reset operation. In this case, because the second reset switch is arranged on the remote diagnosis indication and operation module instead of directly on the contactor, the second reset switch can be operated under the condition that the contactor is electrified without involving safety problems. However, no matter whether the contactor is powered-on or powered-off when the second reset switch is operated, the contactor should undergo re-electrification while the contact of the contactor is disconnected, and the reset signal is detected by the microcontrol unit when the re-electrification occurs, ensuring that the reset operation is safe and the detection of the reset signal is liable. When resetting the contact life diagnosis data, the user has known the occurrence of life diagnosis alarm, and therefore may have carried out related contact replacement or maintenance operation, so the contact of the contactor can be closed after reset to render the contactor continues to work.

In a more specific implementation of the second variant of the first embodiment, similar to the first variant, if the microcontrol unit checks that the diagnosis alarm is in an inactive state in step B, the method can also directly proceed to step E, that is, the microcontrol unit closes the contactor through the actuator, and then the method ends; or the method can also carry out step L while carrying out step E: the microcontrol unit controls the indicator to give a second indication signal indicative the misoperation of the first reset switch, and then the method ends. That is, the second indication information here gives an indication of the misoperation of the second reset switch.

In a more specific implementation according to this second variant of the first embodiment, the remote diagnosis indication and operation module is further provided with a normally open contact, and the execution of step J is based on the closing of the normally open contact. In this case, the close of the normally open contact may be result from the fact that the remote diagnosis indication and operation module receives the diagnosis alarm and gives an indication by closing the normally open contact in response to the diagnosis alarm.

In this way, the method according to various implementations of this second variant may include at least a part of the following:

step J: a reset signal can be provided by changing position of the second reset switch on the remote diagnosis indication and operation module connected with the contactor;

step K: if the step J occurs while the contactor is powered off, re-electrifying the contactor under the condition that the contact of the contactor is disconnected; if the step J occurs while the contactor is powered on, the contactor is powered off first, and then re-electrifying the contactor while the contact of the contactor is disconnected;

step A: detecting a reset signal by a microcontrol unit when re-electrifying the contactor;

if the microcontrol unit does not detect the reset signal in step A, the method proceeds to step E: the microcontrol unit controls the actuator to close the contact of the contactor; then the method ends;

if the microcontrol unit detects the reset signal in step A, the method proceeds to step B: check the state of the diagnosis alarm through the microcontrol unit; wherein:

if the diagnosis alarm is in an inactive state, the method proceeds to step E; or the method simultaneously carries out the above-described step E and the following step I: the microcontrol unit controls the indicator to give a second indication signal indicative misoperation of the second reset switch; and then the method ends;

if the diagnosis alarm is in an active state, the method carries out the following:

step C: the microcontrol unit controls the indicator to give a first indication signal for confirming a reset operation of the diagnosis alarm;

step D: the microcontrol unit resets life diagnosis data;

Step N: the microcontrol unit controls the indicator to stop giving the first indication signal;

step E: the method ends.

The Third Variant of the First Embodiment

Figure 5:
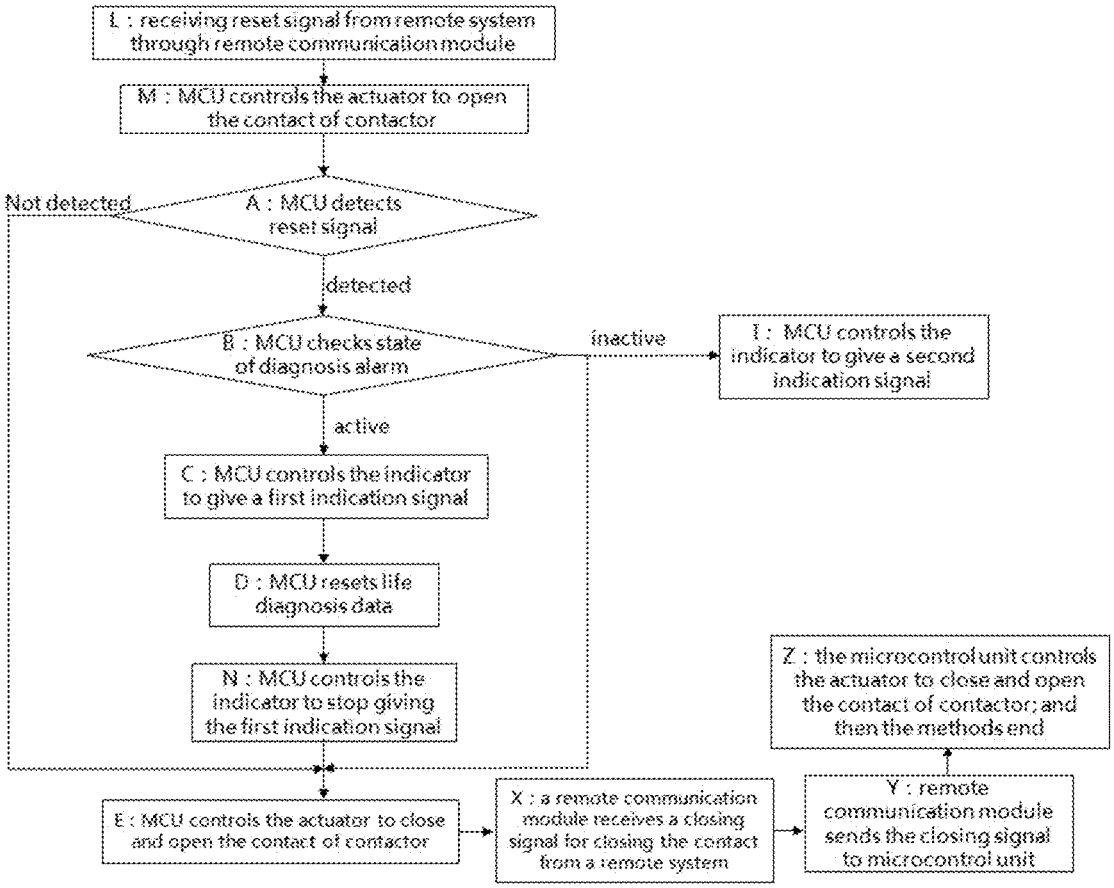
FIG. 5 shows a flowchart of a method according to a third variant of the first embodiment of the present invention.

As shown in FIG. 5, the main difference between this third variant and the first and second variants is that a reset signal is received through a communication interface of a remote communication module of the contactor from a remote system communicatively connected with the remote communication module. According to a third variant, the method comprises at least the following steps:

step L: a reset signal can be received from a remote system through a communication interface of a remote communication module of the contactor while the contactor is powered on;

step A: detecting a reset signal by a microcontrol unit;

step B: if the microcontrol unit detected the reset signal in the step A, checking the state of the diagnosis alarm through the microcontrol unit;

and when the diagnosis alarm is in an active state, the microcontrol unit:

step C: controlling the indicator to give a first indication signal for confirming a reset operation of the diagnosis alarm;

step D: resetting life diagnosis data;

step E: controlling the opening and closing of the contact of the contactor through an actuator.

That is, in this third variant, the contactor includes a remote communication module capable of communicating with a remote system, and the reset signal is sent from the remote system to the remote communication module via a communication interface. With this arrangement, the reset signal can be provided more conveniently and safely, and the reset operation can be started without disconnecting the contact of the contactor in advance or powering off the contactor.

In a more specific implementation of the third variant, if the contact of the contactor is in a closed state when the step L is performed, the method further comprises a step M between the step L and the step A or between the step A or the step B: the microcontrol unit controls the actuator to open the contact of the contactor. This ensures the safety and effectiveness of the reset operation. More specifically, the step E may be to keep the contact of the contactor open through the actuator. Thereafter, the closing of the contact of the contactor is commanded by the remote system, so the method may further include the following steps after step E:

step X: the remote communication module receives a closing signal for closing the contact of the contactor from the remote system through the communication interface;

step Y: the remote communication module transmits the closing signal to the microcontrol unit;

step Z: the microcontrol unit controls the actuator to close the contact of the contactor.

In a more specific implementation or the third variant, if the microcontrol unit checks that the diagnosis alarm is in an inactive state, the method proceeds to step E after step B: keeping open of the contact of the contactor through the actuator. This situation may indicate the failure or misoperation of the remote communication module or remote system. Optionally, in this case, the microcontrol unit can also control the indicator to give relevant error operation indication signals.

In this way, the method according to various implementations of this second variant may include at least a part of the following:

step L: a reset signal can be received from a remote system through a communication interface of a remote communication module of the contactor while the contactor is powered on;

step M: if the contactor is in a closed state when the step L is carried out, the microcontrol unit controls the actuator to open the contact of the contactor;

step A: detecting a reset signal by a microcontrol unit;

step B: checking the state of the diagnosis alarm through the microcontrol unit; wherein:

when the diagnosis alarm is in an active state, the method carries out the following:

step E: keeping the contact of the contactor disconnected through the actuator; or the method simultaneously carries out the step E and the following step I: the microcontrol unit controls the indicator to give an indication signal indicate an operation error of the remote communication module;

step X: the remote communication module receives a closing signal for closing the contact of the contactor from the remote system through the communication interface;

step Y: the remote communication module transmits the closing signal to the microcontrol unit;

step Z: the microcontrol unit controls the actuator to close the contact of the contactor.

when the diagnosis alarm is in an active state, the method carries out the following:

step C: the microcontrol unit controls the indicator to give a first indication signal for confirming a reset operation of the diagnosis alarm;

step D: the microcontrol unit resets life diagnosis data;

step N: the microcontrol unit controls the indicator to stop giving the first indication signal;

step E: the microcontroller keeps the contact of the contactor to be disconnected through the actuator;

step X: the remote communication module receives a closing signal for closing the contact of the contactor from the remote system through the communication interface;

step Y: the remote communication module transmits the closing signal to the microcontrol unit;

step Z: the microcontrol unit controls the actuator to close the contact of the contactor; then the method ends.

The Second Embodiment

Figure 6:
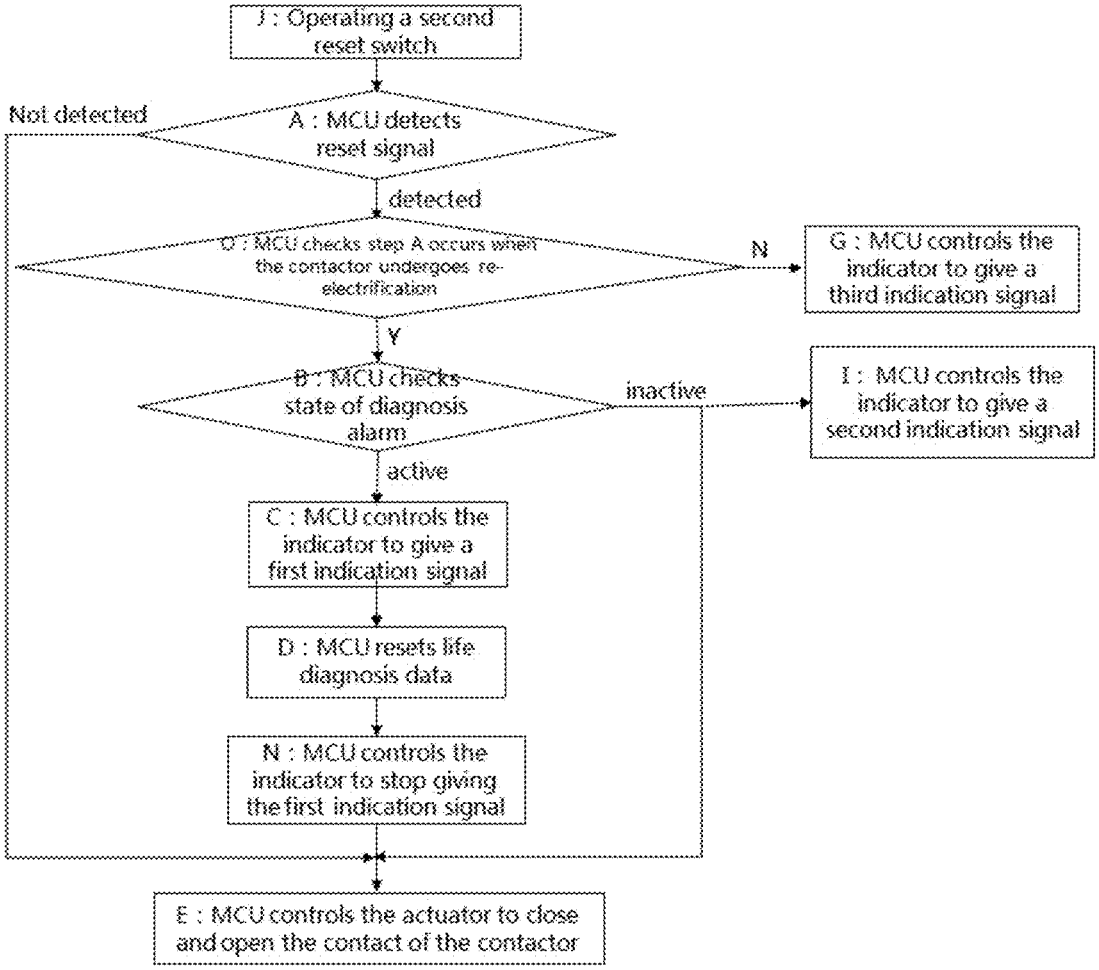
FIG. 6 shows a flowchart of a method according to a second embodiment of the present invention.

As shown in FIG. 6, in this second embodiment, a method for resetting life diagnosis alarm of a contact of a contactor is provided, which comprises the following steps:

step J: under the condition that the contact of the contactor is disconnected, providing the reset signal by changing poisition of a second reset switch on a remote diagnosis indication and operation module connected with the contactor;

step A: detecting a reset signal by a microcontrol unit;

step O: under the condition that the microcontrol unit detects the reset signal, the microcontrol unit checks whether the step A occurs when the contactor undergoes re-electrification;

step B: in the step O, if it is checked that the step A occurs when the contactor undergoes re-electrification, the microcontrol unit checks the state of the diagnosis alarm;

and when the diagnosis alarm is in an active state, the microcontrol unit:

step C: controlling the indicator to give a first indication signal for confirming a reset operation of the diagnosis alarm;

step D: resetting the historical data of life diagnosis;

step E: controlling the opening and closing of the contact of the contactor through an actuator.

That is, this second embodiment is similar to the second variant of the first embodiment, but the difference lies in the step O, namely before the microcontrol unit checks the state of the diagnosis alarm, it is necessary to check whether it is when the contactor undergoes re-electrification that the microcontrol unit detects the reset signal.

In a more specific implementation of the second embodiment, if it is checked in the step O that it is not when the contactor undergoes re-electrification that the step A occurs, the method proceeds to step G: the microcontrol unit controls the indicator to give a third indication signal indicative error in the reset operation, and the third indication signal is different from the first indication signal.

It can be seen that the most critical difference between this second embodiment and the first embodiment is that before checking the state of the diagnosis alarm through the microcontrol unit, it is necessary to check whether the detection of the reset signal occurs when the contactor is being re-electrified, since in this second embodiment, the second reset switch is arranged on the remote diagnosis indication and operation module, and as a result the second reset switch can be operated either while the contactor is powered on or while the contactor is powered off. The detection of the reset signal should occur when the contactor is being re-electrified, so that the subsequent reset operation can be carried out correctly and safely, otherwise, the indicator should report an error. More specifically, if a reset signal is provided by changing the position of the second reset switch in case that the contactor is powered off, the reset signal should be detected by the microcontroller when the contactor is being re-electrified; if the reset signal is provided by changing the position of the second reset switch while the contactor is powered on, the contactor should be powered off first and then the reset signal should be detected by the microcontroller when the contactor is being re-electrified—in this case, if the contactor is not powered off first, this way of operation may lead to an error or incompleteness of the reset operation, and thus if this is checked in step O, an error operation indication will be given by the indicator.

Other specific implementations of this second embodiment can refer to the corresponding implementations of the second variant of the first embodiment, for example, step E is to close the contact of the contactor by the actuator; in step A, if the microcontroller does not detect the reset signal, the method proceeds to step E, and then the method ends.

In addition, in a more specific implementation of the second embodiment, in step B, if the microcontrol unit detects that the diagnosis alarm is in an inactive state, the method proceeds to step E and then ends; or the method simultaneously carries out the step E and the following step I: the microcontrol unit controls the indicator to give a second indication signal indicative misoperation of the second reset switch. It should be noted that the first indication signal, the second indication signal and the third indication signal are all different from each other and selected from flashing patterns or modes of indicator lights, sounds, or any combination thereof.

In a more specific implementation of the second embodiment, similar to the second variant of the first embodiment, the remote diagnosis indication and operation module is further provided with a normally open contact, and the execution of step J is based on the closing of the normally open contact. In this case, the close of the normally open contact may be result from the fact that the remote diagnosis indication and operation module receives the diagnosis alarm and gives an indication by closing the normally open contact in response to the diagnosis alarm.

Similar to the first embodiment, in a specific implementation according to the second embodiment, the method may further include a step N between step D and step E: the microcontrol unit causes the indicator to stop giving the first indication signal. That is, the stop of the first indication signal can conveniently and clearly indicate the completion of the reset operation, further ensuring the safety and effectiveness of subsequent operations.

In this way, the method according to various implementations of this second embodiment may include at least a part of the following:

step J: a reset signal can be provided by changing position of a second reset switch on a remote diagnosis indication and operation module connected with the contactor;

step A: detecting a reset signal by a microcontrol unit; wherein:

if the microcontrol unit does not detect the reset signal in step A, the method proceeds to step E: the microcontrol unit controls the actuator to close the contact of the contactor; then the method ends;

if the microcontrol unit detects the reset signal in the step A, the method proceeds to step O: checking by the microcontrol unit whether step A occurs when the contactor is being re-electrified; wherein:

if it is checked by the microcontrol unit in the step O that it is not when the contactor undergoes re-electrification that the step A occurs, step G is performed: the microcontrol unit controls the indicator to give a third indication signal indicative error in the reset operation;

if it is checked by the microcontrol unit that it is when the contactor undergoes re-electrification that the step A occurs, the method proceeds to step B: checking the state of the diagnosis alarm through the microcontrol unit; wherein:

if the diagnosis alarm is in an inactive state, the method proceeds to step E; or the method simultaneously carries out the above-described step E and the following step I: the microcontrol unit controls the indicator to give a second indication signal indicative misoperation of the second reset switch; and then the method ends.

if the diagnosis alarm is in an active state, the method carries out the following:

step C: the microcontrol unit controls the indicator to give a first indication signal indicative of occurrence of the life diagnosis alarm;

step D: the microcontrol unit resets life diagnosis data;

step N: the microcontrol unit controls the indicator to stop giving the first indication signal;

step E: the method ends.

The exemplary implementations of the method for resetting life diagnosis alarm of a contact of a contactor proposed by the present invention has been described in detail above with reference to the preferred embodiments, but it is understood by those skilled in the art that without departing from the concept of the present invention, various modifications and variations can be made to the above specific implementations, and various technical features and structures proposed by the present invention can be combined in various ways without exceeding the protection scope of the present invention.

The scope of the present disclosure is not limited by the above-described embodiments, but by the appended claims and their equivalents.

The invention claimed is:

1. A method for resetting life diagnosis alarm of a contact of a contactor, including the following steps:

Step A: detecting a reset signal by a microcontrol unit;

Step B: when the microcontrol unit has detected the reset signal, checking the state of the diagnosis alarm through the microcontrol unit;

and when the diagnosis alarm is in an active state, the microcontrol unit:

Step C: controlling the indicator to give a first indication signal for confirming a reset operation of the diagnosis alarm;

Step D: resetting life diagnosis data;

Step E: controlling the opening and closing of the contact of the contactor through an actuator.

2. The method as claimed in claim 1, wherein the method includes the following steps before the step A:

Step G: when the contactor is powered off, the reset signal can be provided by changing position of a first reset switch integrated in the contactor;

Step H: under the condition that the contact of the contactor is disconnected, the contactor is re-electrified;

and wherein the step A is performed when the step H occurs.

3. The method as claimed in claim 1, wherein the method includes the following steps before the step A:

Step J: a reset signal can be provided by changing position of a second reset switch on a remote diagnosis indication and operation module connected with the contactor;

Step K: if the step J occurs when the contactor is powered off, re-electrifying the contactor under the condition that it is confirmed that the contact of the contactor is disconnected; if the step J occurs while the contactor is powered on, the contactor is powered off first, and then the contactor is re-electrified while the contact of the contactor is confirmed to be disconnected;

and wherein the step A is performed when the contactor is re-electrified in the step K.

4. The method as claimed in claim 1, wherein the step E is to closed the contact of the contactor through the actuator.

5. The method as claimed in claim 4, wherein in the step A, if the microcontrol unit does not detect the reset signal, the method proceeds to the step E.

6. The method as claimed in claim 4, wherein in the step B, if the microcontrol unit detects that the diagnosis alarm is in an inactive state, the method proceeds to step E; or the method simultaneously carries out the step E and the following step I: the microcontrol unit controls the indicator to give a second indication signal indicative misoperation of the first reset switch or the second reset switch;

and wherein the second indication signal is different from the first indication signal.

7. The method as claimed in claim 6, wherein the first indication signal and the second indication signal are both selected from flashing patterns or modes of indicator lights, sounds, or any combination thereof.

8. The method as claimed in claim 1, wherein the method includes a step L before the step A: the reset signal can be received from a remote system through a communication interface of a remote communication module of the contactor while the contactor is powered on.

9. The method as claimed in claim 8, wherein if the contact of the contactor is in a closed state when the step L is performed, the method further comprises a step M between the step L and the step A or between the step A or the step B: the microcontrol unit controls the actuator to open the contact of the contactor.

10. The method as claimed in claim 9, wherein the step E is to keep the contact of the contactor open through the actuator.

11. The method as claimed in claim 10, wherein if the microcontrol unit checks that the diagnosis alarm is in an inactive state in the step B, the method proceeds to step E after the step B.

12. The method as claimed in claim 11, wherein the method further includes the following steps after the step E:

Step X: the remote communication module receives a closing signal for closing the contact of the contactor from the remote system through the communication interface;

Step Y: the remote communication module transmits the closing signal to the microcontrol unit;

Step Z: the microcontrol unit controls the actuator to close the contact of the contactor.

13. The method as claimed in claim 1, wherein a step N may be further included between the step D and the step E: the microcontrol unit controls the indicator to stop giving the first indication signal.

14. A method for resetting life diagnosis alarm of a contact of a contactor, including the following steps:

Step J: under the condition that the contact of the contactor is disconnected, providing the reset signal by changing poisition of a second reset switch on a remote diagnosis indication and operation module connected with the contactor;

Step A: detecting a reset signal by a microcontrol unit;

Step O: under the condition that the microcontrol unit detects the reset signal, the microcontrol unit checks whether the step A occurs when the contactor undergoes re-electrification;

Step B: in the step O, if it is checked that the step A occurs when the contactor undergoes re-electrification, the microcontrol unit checks the state of the diagnosis alarm;

and when the diagnosis alarm is in an active state, the microcontrol unit:

Step C: controlling the indicator to give a first indication signal for confirming a reset operation of the diagnosis alarm;

Step D: resetting the historical data of life diagnosis;

Step E: controlling the opening and closing of the contact of the contactor through an actuator.

15. The method as claimed in claim 14, wherein if it is checked in the step O that it is not when the contactor undergoes re-electrification that the step A occurs, step G is performed:

the microcontrol unit controls the indicator to give a third indication signal indicative error in the reset operation, and the third indication signal is different from the first indication signal.

16. The method as claimed in claim 15, wherein the step E is to close the contact of the contactor through the actuator.

17. The method as claimed in claim 16, wherein in the step A, if the microcontrol unit does not detect the reset signal, the method proceeds to the step E.

18. The method as claimed in claim 17, wherein in the step B, if the microcontrol unit detects that the diagnosis alarm is in an inactive state, the method proceeds to step E; or the method simultaneously carries out the step E and the following step I: the microcontrol unit controls the indicator to give a second indication signal indicative misoperation of the second reset switch;

and wherein the first indication signal, the second indication signal and the third indication signal are different from each other.

19. The method as claimed in claim 18, wherein the first indication signal, the second indication signal and the third indication signal are all selected from flashing patterns or modes of indicator lights, sounds, or any combination thereof.

20. The method as claimed in claim 14, wherein a step N may be further included between the step D and the step E: the microcontrol unit controls the indicator to stop giving the first indication signal.

* * * * *